US006026657A

United States Patent [19]

Magnet et al.

[11] Patent Number: 6,026,657

[45] Date of Patent: Feb. 22, 2000

[54] PROCESS AND PLANT FOR SUPPLYING A BLAST FURNACE

[75] Inventors: Didier Magnet, Vincennes; Emmanuel Garnier, Paris, both of France

[73] Assignee: L'Air Liquide, Societe Anonyme pour l'Etude et l'Exploitation des Procedes Georges Claude, Paris Cedex, France

[21] Appl. No.: 09/111,933

[22] Filed: Jul. 8, 1998

[30] Foreign Application Priority Data

Jul. 8, 1997 [FR] France ..... 97 08659

[51] Int. Cl.[7] ..... F25J 3/00

[52] U.S. Cl. ..... 62/643; 60/39.12; 62/646; 62/510; 62/915

[58] Field of Search ..... 62/643, 646, 915, 62/510; 60/39.12

[56] References Cited

U.S. PATENT DOCUMENTS

| | | | |
|---|---|---|---|
| 3,954,430 | 5/1976 | Curtis et al. | 62/510 |
| 5,268,019 | 12/1993 | Rathbone | 60/39.12 |
| 5,454,226 | 10/1995 | Darredeau et al. | 62/646 |

FOREIGN PATENT DOCUMENTS

| | | |
|---|---|---|
| 2 378 096 | 8/1978 | France . |
| 252584 | 7/1911 | Germany . |
| 956 166 | 1/1957 | Germany . |
| 54-019404 | 2/1979 | Japan . |
| 54-102206 | 8/1979 | Japan . |
| 54-161504 | 12/1979 | Japan . |

*Primary Examiner*—Ronald Capossela

*Attorney, Agent, or Firm*—Young & Thompson

[57] ABSTRACT

A blast furnace (1) is supplied with a flow of optionally oxygen-enriched air coming from an isothermal compressor (3) or a (radial) centrifugal compressor (11).

14 Claims, 1 Drawing Sheet

PROCESS AND PLANT FOR SUPPLYING A BLAST FURNACE

FIELD OF THE INVENTION

The present invention relates to a process and a plant for supplying a blast furnace.

BACKGROUND OF THE INVENTION

A blast furnace is supplied at its base with a large quantity of air, optionally enriched with oxygen, called a "blast". This blast is generally compressed, often to a pressure of between 3 and 6 bar, by one or more axial compressors called "blowers".

Since these compressors are not equipped with an interstage cooler, the compression then carried out is of the adiabatic type and some of the energy expended serves to heat the blast which, thus compressed, leaves the blower at a temperature of between 150° and 250° C.

The amount of water contained in the blast corresponds in this case to the amount of water contained in the ambient air.

SUMMARY OF THE INVENTION

The object of the invention is to decrease the energy consumption of the compressor which supplies a blast furnace.

Another object of the invention is to reduce the investment cost of the plant.

According to one subject of the invention, a process is provided for supplying a blast furnace characterized in that at least part of the air or of the oxygen-enriched air intended for the blast furnace comes from a compressor having N compression stages with at least one-isothermal compression stage.

According to other aspects of the invention:

- air, optionally oxygen-enriched, coming from the isothermal compressor is sent to a heating means upstream of the blast furnace,
- the final compression stage is an isothermal compression stage,
- part of the air coming from the compressor is sent to an air separation apparatus producing at least one gas from the air,
- a gas from the air coming from the air separation apparatus is sent to the blast furnace.

According to another subject of the invention, a plant is provided for supplying a blast furnace, comprising means for compressing optionally oxygen-enriched air intended for the blast furnace, characterized in that these means comprise a compressor having N compression stages, with at least one isothermal compression stage.

According to other aspects of the invention:

- the compression means consist of a centrifugal-type compressor,
- means for heating the air are downstream of the compression means and upstream of the blast furnace,
- refrigeration means are downstream of the N-1th stage or downstream of the final stage,
- the means for cooling the air coming from the compression means consist of a direct-contact or indirect-contact cooler,
- the air from the compression means is sent to an air separation apparatus producing at least one gas from the air, and
- a gas from the air from the air separation apparatus is sent to the blast furnace.

BRIEF DESCRIPTION OF THE DRAWINGS

Other details of the invention will now be illustrated in the following figures, wherein.

DETAILED DESCRIPTION OF THE INVENTION

Figure 1:
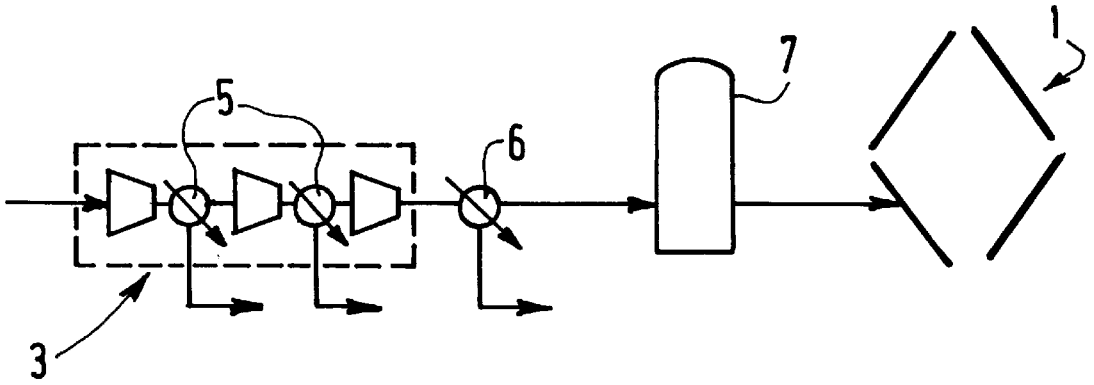
FIGS. 1, 2 and 3 are alternate diagrammatical representations of plant for supplying a blast furnace according to the invention.

In FIG. 1, air intended for a blast furnace 1 is compressed to between 3 and 6 bar in an isothermal compressor 3 equipped with interstage coolers 5.

Some of the water vapour contained in the air will be removed by condensation when passing through these coolers 5. The air leaves the compressor at approximately 100° C. and may optionally be cooled by a suitable refrigeration system, such as a water cooler 6.

The air thus dried is heated in "Cowpers" 7 up to 1000° C., before being injected into the blast furnace 1.

Figure 2:
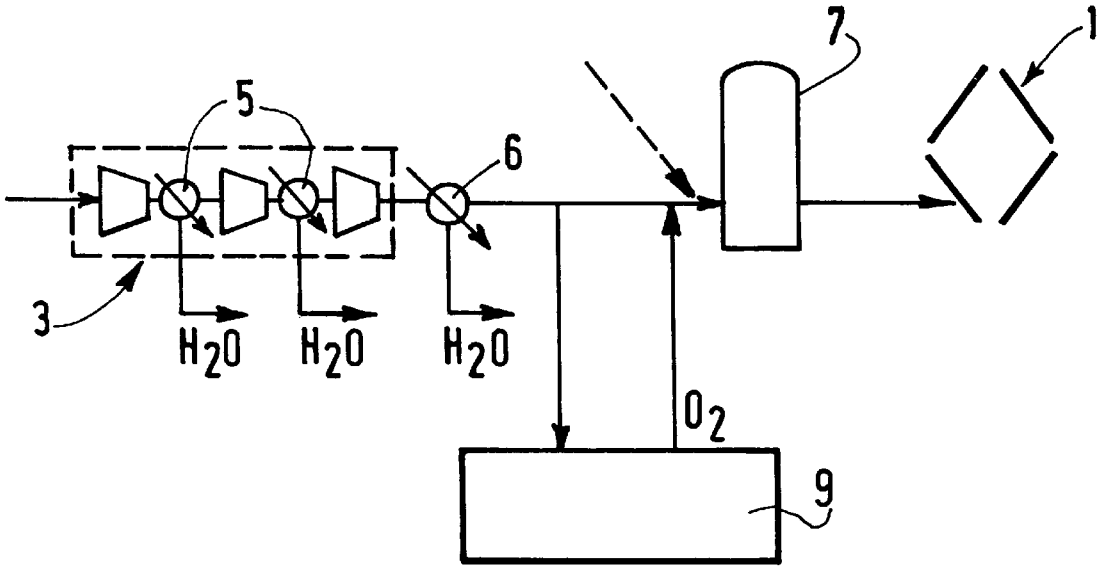

As may be seen in FIG. 2, some of the air coming from the isothermal compressor 3 may be taken off upstream of the "Cowpers" 7 and sent to an air separation apparatus 9 comprising air distillation columns. The oxygen produced by this apparatus may enrich the air intended for the blast furnace and be heated with this air in the "Cowpers" 7. Obviously, other types of air separation apparatus may be used.

The air separation apparatus 9 may therefore be entirely or partially supplied from the isothermal compressor. This compressor may be of the centrifugal type.

Figure 3:
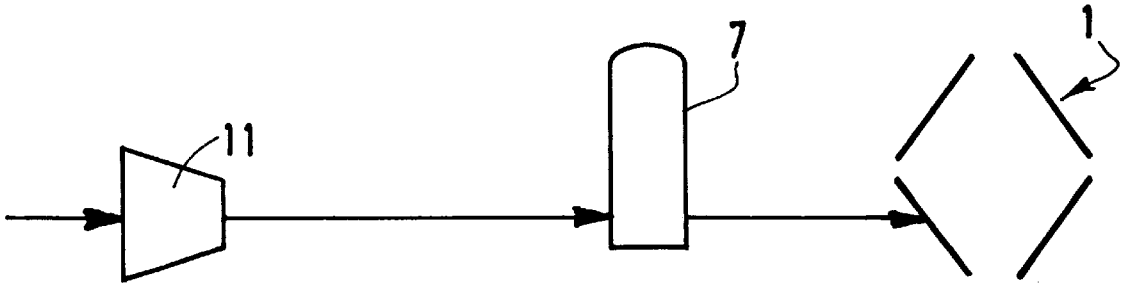

In FIG. 3, the blast furnace is supplied with air coming from a centrifugal compressor 11, having no interstage refrigeration. The compression is therefore of the adiabatic type.

The advantage of this invention is that it allows a substantial reduction in the manufacturing cost of the pig iron produced by the blast furnace.

The factors contributing to this reduction are the following:

- the decrease in the energy consumption of the blower by the use of isothermal compressors which consume much less energy than adiabatic compressors for compressing the same flow of air at a given pressure;
- the optional use of centrifugal compressors which are less expensive in terms of investment than the axial compressors usually installed for this application; and
- the reduction in coke consumption in the blast furnace because the blast is partially dried by condensing some of the water vapour contained in the air.

This drying operation prevents the endothermic reaction of water vapour reduction to hydrogen in the smelting zone of the blast furnace and consequently reduces the coke consumption.

The drying operation is carried out by condensing the water vapour in the air passing through the interstage coolers of the isothermal compressor and, optionally, through the final cooler of the blower when it is economically advantageous to install this cooler.

The air will, in this case, be injected into the "Cowpers" at a lower temperature than in the case of the use of an adiabatic blower, which will result in an increase in fuel consumption necessary for heating the blast in the case of plants having a regenerator for recovering the heat from the flue gases leaving the "Cowpers".

Since in most cases the flue gases are vented at a temperature of greater than 250° C., the consequence of supplying the "Cowpers" with optionally refrigerated air coming from an isothermal compressor will in fact be to reduce the temperature at which the flue gases are vented, but will not produce an increase (or limited increase) in the fuel consumption for heating the blast.

Alternatively, supplying an air separation unit from this same isothermal blower will make it possible to produce at least one gas from the air for the requirements of the blast furnace and/or of other consumers, by benefiting from a synergy with regard to the air compression, thus allowing a reduction in the overall investment and consequently a reduction in the cost of the gases thus produced.

We claim:

1. Process for supplying air to a blast furnace, which comprises:

providing a compressor having a plurality of compression stages with at least one isothermal final stage;

feeding air to the compressor so as to obtain a flow of compressed air;

providing a blast furnace downstream of the compressor; and supplying the flow of compressed air to the blast furnace.

2. Process according to claim 1, further comprising providing a heater downstream of the compressor and upstream of the blast furnace; and sending the flow of compressed air to the heater.

3. Process according to claim 2, wherein the flow of compressed air is enriched with oxygen.

4. Process according to claim 1, wherein all the compression stages are isothermal compression stages.

5. Process according to claim 1, further comprising providing an air separation apparatus; and sending part of the flow of compressed air to the air separation apparatus so as to produce at least one gaseous product.

6. Process according to claim 5, further comprising sending said at least one gaseous product to the blast furnace.

7. Plant for supplying air to a blast furnace, comprising:

a source of air;

a compressor having an inlet fluidly connected to the source of air for compressing air, and an outlet for a flow of compressed air; said compressor having a plurality of compression stages with at least one isothermal final compression stage; and a blast furnace having an inlet fluidly connected to the outlet of the compressor.

8. Plant according to claim 7, wherein the compressor is a centrifugal-type compressor.

9. Plant according to claim 7, further comprising heating means for heating of the flow of compressed air, said heating means being positioned downstream of the compressor and upstream of the blast furnace.

10. Plant according to claim 7, further comprising cooling means for refrigerating the final compression stage.

11. Plant according to claim 10, wherein the cooling means for refrigerating air coming from the compressor consist of a direct-contact or indirect-contact cooler.

12. Plant according to claim 7, further comprising means for sending air from the compressor to an air separation apparatus for producing at least one product gas from the air.

13. Plant according to claim 12, further comprising means for sending said at least one product gas from the air separation apparatus to the blast furnace.

14. Plant for supplying air to a blast furnace, comprising:

a source of air optionally enriched with oxygen;

a centrifugal adiabatic compressor having an inlet fluidly connected to the source of air for compressing air, and an outlet for a flow of compressed air;

heating means having an inlet fluidly connected to the outlet of the centrifugal adiabatic compressor for heating the flow of compressed air, and an outlet for heated compressed air; and a blast furnace having an inlet fluidly connected to the outlet of the heating means.

* * * * *